United States Patent [19]

Wawro et al.

[11] 4,410,033

[45] Oct. 18, 1983

[54] COMBINATION COUPLING RETAINER AND SUPPORT FOR A HEAT EXCHANGE UNIT

[75] Inventors: Thaddeus J. Wawro, Auburn; Timothy A. Wright, Chittenango, both of N.Y.

[73] Assignee: Carrier Corporation, Syracuse, N.Y.

[21] Appl. No.: 279,656

[22] Filed: Jul. 2, 1981

[51] Int. Cl.[3] ..... F25D 19/00; F25D 21/14

[52] U.S. Cl. ..... 165/78; 62/288; 62/298; 62/299; 62/326; 165/137; 165/178

[58] Field of Search ..... 165/137, 178, 76, 78; 62/285, 286, 288, 290, 291, 289, 298, 299, 326

[56] References Cited

U.S. PATENT DOCUMENTS

| | | | |
|---|---|---|---|
| 1,299,955 | 4/1919 | Jones | 165/78 X |
| 2,690,654 | 10/1954 | Graham | 62/326 X |
| 3,299,660 | 1/1967 | Sullivan | 62/285 |
| 3,596,475 | 8/1971 | Berger | 62/285 |
| 3,882,690 | 5/1975 | Duell et al. | 62/288 |
| 3,902,551 | 9/1975 | Lim et al. | 62/288 X |
| 3,905,789 | 9/1975 | Carpenter | 62/299 |
| 4,129,013 | 12/1978 | Hine, Jr. | 62/285 |

OTHER PUBLICATIONS

28 AR Carrier Literature.

*Primary Examiner*—Sheldon J. Richter

*Attorney, Agent, or Firm*—Donald F. Daley; Robert P. Hayter

[57] ABSTRACT

A heat exchange unit is disclosed having a combination coupling retainer and support. This combination coupling retainer and support acts to both secure a suction line coupling and a liquid line coupling connected to the appropriate headers of the heat exchanger and to provide structural support for the heat exchange unit. The coupling retainer and support includes a suction line opening for securing the suction line coupling therein and a liquid line slot in an arcuate configuration adapted to secure the liquid line coupling. This combination retainer and support is capable of being used in various units with heat exchangers mounted at differing angles, the suction line coupling serving as a pivot point and the liquid line coupling being positioned within the liquid line slot to secure the various components.

9 Claims, 4 Drawing Figures

COMBINATION COUPLING RETAINER AND SUPPORT FOR A HEAT EXCHANGE UNIT

BACKGROUND OF THE INVENTION

1. Field of the Invention

The present invention relates to heat exchange units for transferring heat energy between refrigerant and air. More specifically, the present invention relates to a combination coupling retainer for securing the refrigerant connections between the heat exchange unit and the refrigeration circuit and a retainer for structurally supporting the heat exchanger.

2. Description of the Prior Art

Heat exchange assemblies having a casing defining an air flow path and a fan for moving the air along said air flow path have long been known in the art. In order to reduce the number of models of heat exchange units supplied by manufacturers it is desirable to produce units which may be mounted either in a vertical or horizontal position. To further reduce the number of components required for the various models of heat exchange units it is desirable to produce components for securing the heat exchanger in the unit which are commonly applicable to units of varying sizes.

Heat exchange coils may vary in number of rows of tubes, depth, height, width, fin density, the angle of the heat exchanger relative to the air flow path and numerous other factors. In a family of units it is typical to provide a series of heat exchange coils of various sizes utilizing a single size casing. As the heat exchange coil size changes, the angle at which it is mounted or other physical positioning may change within a cabinet of an established size.

To promote the ease of mounting of various coils in a single cabinet size or casing size unit a coupling retainer and support may be used making it possible to mount the coil at different angles. Prior art devices have included a separate support for each coil such that each coil has its own specific physical arrangement for securing the coil to the casing.

The invention as set forth herein includes a combination coupling retainer and support. The support is secured to a flange of the heat exchanger. The support includes a pivot point where the suction line coupling is secured to act as a pivot point for the entire heat exchanger. A liquid line slot having a curved opening through which the liquid line extends is also provided. Hence, the heat exchanger may be rotated about the suction line coupling and the liquid line slides within the liquid line slot as the heat exchanger is displaced.

In addition to the above, the condensate pan is secured to the base of the heat exchanger. This condensate pan has a drain projection having drain openings for the discharge of condensate. A cover plate is designed for each model unit which is adapted to receive the drain pan projection and to receive the liquid line and suction line extending from the heat exchanger. This cover plate acts to secure the drain pan projection and the two refrigerant carrying lines such that the heat exchanger is secured in position. Additionally, a screw or other fastening means may be used from the cover plate to secure the retainer in position thereby securing the heat exchanger. Hence, by the utilization of this combination coupling retainer and support, a single element may be used with numerous units by rotating the heat exchanger relative to the casing in which it is mounted. The combination coupling retainer and support includes means for allowing the heat exchanger to pivot about the suction line coupling and the liquid line coupling which is positioned in the arcuate slot in the retainer.

SUMMARY OF THE INVENTION

An object of the present invention is to provide means for securing a heat exchanger in a heat exchange unit.

A further object of the present invention is to provide a coupling retainer for securing the liquid and suction lines of a heat exchanger in position.

A further object of the present invention is to provide an interchangeable combination coupling retainer and support for use with numerous sizes of heat exchanger units.

A further object of the present invention is to provide a safe, economical and reliable method of assembling an air conditioning unit.

Other objects will be apparent from the description to follow and from the appended claims.

The preceeding objects are achieved according to a preferred embodiment of the invention by the provision of a heat exchange unit capable of transferring heat energy between a refrigerant and air. The heat exchange unit includes a casing defining an air flow path, a heat exchanger having refrigerant flowing therethrough and being located in the air flow path for effecting heat transfer between the refrigerant and air, said heat exchanger including a liquid header and suction header. A condensate pan is attached to the heat exchanger and includes a drain projection. A coupling retainer is mounted to the heat exchanger and defines a liquid line slot and a suction line opening. The liquid line coupling is connected at one end to the liquid line header and extends through the liquid line opening in the coupling retainer. The suction header coupling is connected to one end of the suction header and extends through the suction line opening of the retainer, said suction header serving as a pivot point about which the coupling retainer and attached heat exchanger may be rotated. A cover plate defining a drain projection opening for receiving the drain projection, a liquid line opening through which the liquid coupling extends and a suction line opening through which the suction coupling extends may additionally be secured as part of the unit and may further include fastening means for securing the retainer relative to the heat exchange unit.

DESCRIPTION OF THE PREFERRED EMBODIMENT

The embodiment described herein will be for use in a fan coil unit of an air conditioning system. It is to be understood that this fan coil unit, although described as an evaporator, could likewise be the indoor coil of a heat pump or the heat exchanger of some other application where air is being cooled.

Figure 1:
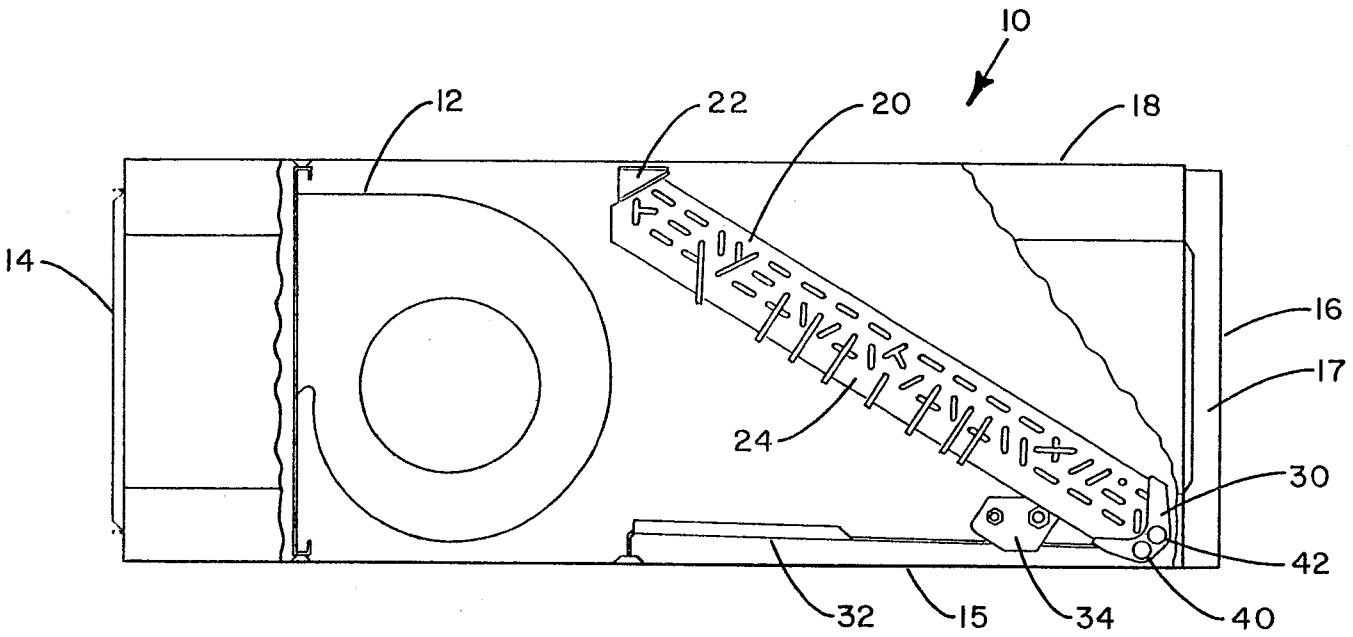
FIG. 1 is a cutaway side view of a fan coil unit including an evaporator and condensate pan.

Referring to FIG. 1, it can be seen that unit 10 includes fan 12, evaporator 20 and casing 18. Casing 18 defines an air flow portion including air intake 16 and air discharge 14. Fan 12 acts to draw the air to be conditioned through air intake 16 over the surfaces of the evaporator 20 and discharge the same through air discharge 14. Casing 18 defines the structure of unit 10 and includes base portion 17 and side wall 15. Evaporator 20 has tube sheet 24 at an end thereof and numerous tube openings and connections such as return bends and tripods located at the edge thereof. Condensate pan 30 is located at the lower end of evaporator 20 and has first drain opening 40 and second drain opening 42 at the end thereof. Bracket 22 is mounted at the upper end of evaporator 20 connecting tube sheet 24 to casing 18. Retainer 34 is mounted to the tube sheet towards the lower end of evaporator 20 and extends downwardly therefrom. Drip pan 32 extends across the bottom surface of the unit and is located to receive condensate falling from the evaporator and to conduct said condensate to the condensate pan 30.

Figure 2:
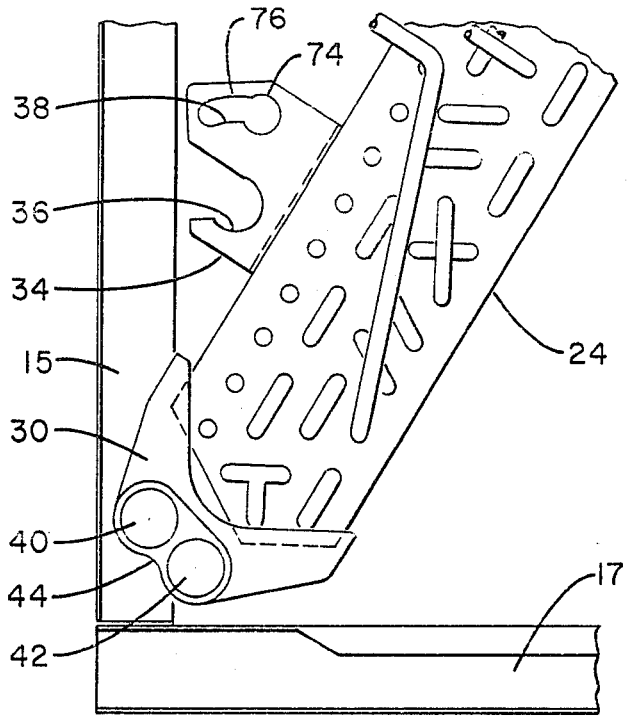
FIG. 2 is a cutaway view of a portion of the heat exchanger and condensate pan shown mounted in the vertical position.

FIG. 2 shows a portion of the unit with the unit being mounted in the vertical position. In this view it may be seen that retainer 34 extends from the tube sheet and includes therein suction line opening 36 and liquid line slot 38, the liquid line slot having a curvilinear tail portion 76 and a head portion 74. Tube sheet 24 extends into condensate pan 30 having first drain opening 40 and second drain opening 42 formed in drain projection portion 44. Side wall 15 and base portion 17 are additionally shown.

Figure 3:
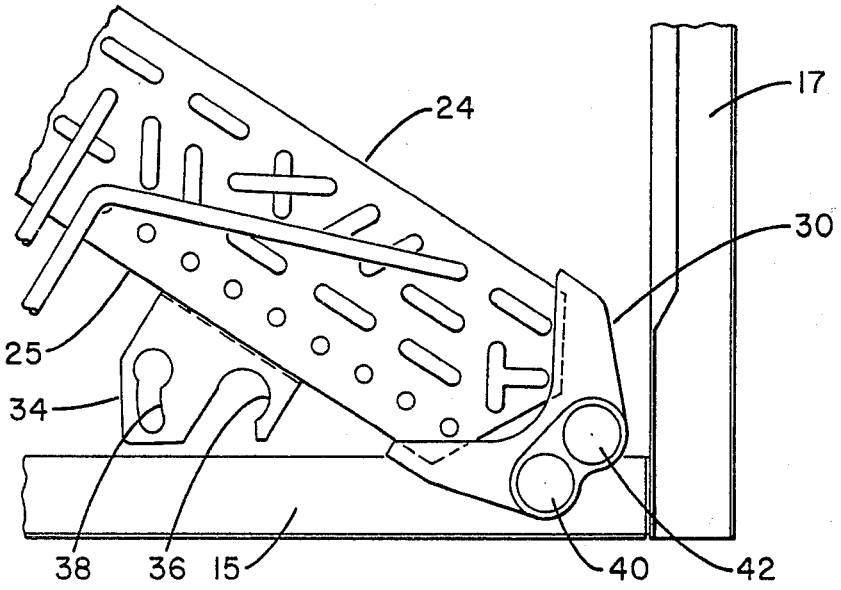
FIG. 3 is a cutaway view of a portion of the condensate pan and heat exchanger shown mounted in the horizontal position.

FIG. 3 is an identical view to FIG. 2 with the unit mounted in the horizontal position. In this position it may be seen that first drain opening 40 is located at the bottom level of the condensate pan whereas in the previous view, FIG. 2, the second drain opening 42 is located at the bottom level of the condensate pan. The remaining components of the unit are identical to the previous figure. Flange 25 of tube sheet 24 is specifically referenced to indicate the manner in which retainer 40 is secured thereto.

Figure 4:
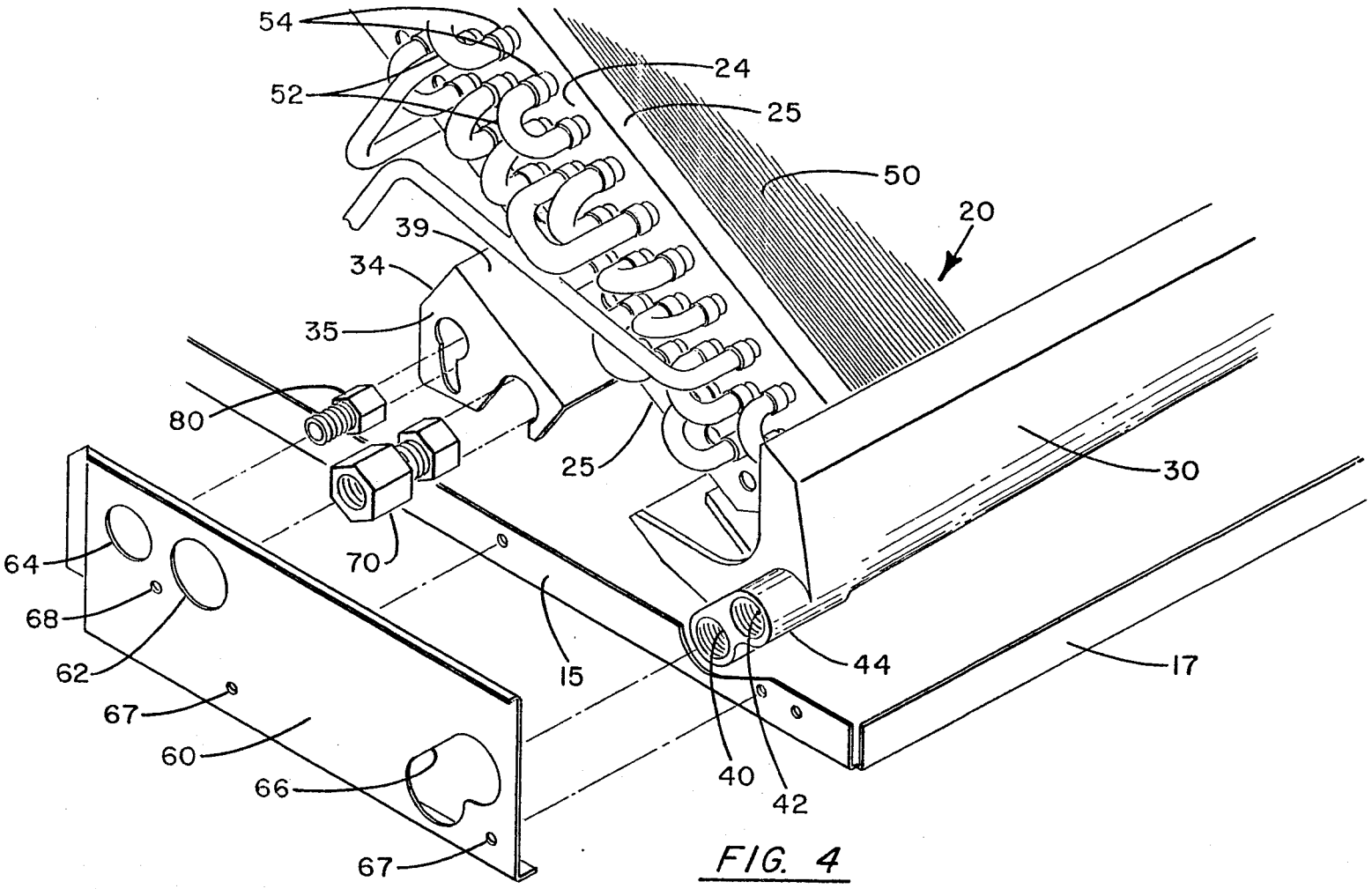
FIG. 4 is a perspective view of a portion of the fan coil unit showing the condensate pan, heat exchanger and cover plate with the heat exchanger being mounted in the horizontal position.

FIG. 4 is a perspective view of a portion of the unit including the plate and couplings. As may be seen in FIG. 4, condensate pan 30 is a generally trough-shaped longitudinally extending container having drain projection 44 extending from the end thereof. First drain opening 40 and second drain opening 42 are shown formed as threaded openings in drain projections 44. It is contemplated that a drain line for conducting condensate from the unit to a disposal location will be connected to one of these openings and the other may be plugged or left open as a secondary overflow drain.

Retainer 34 is shown having front portion 35 defining liquid line slot 38 and suction line opening 36 and extension portion 39 extending to flange 25 of tube sheet 24. Liquid header coupling 80 is shown as it would be assembled to the unit as is suction header coupling 70. The headers from the coil would be secured with the liquid header being secured to the liquid header coupling 80 and the suction header being secured to suction header coupling 70 such that the piping of the unit would form a closed circuit between the couplings 70 and 80. The liquid line coupling is sized having a diameter greater than the suction line opening such that the liquid line coupling is snapped into position.

Cover plate 60 is shown for attachment to the casing of the unit. Cover plate 60 defines a liquid line opening 64, suction line opening 62, drain projection opening 66 and has mounting holes 67 and retainer fastener hole 68. As seen in this exploded view it is apparent that the cover plate, when assembled, acts to engage the drain projection 44 in drain projection opening 66 securing the condensate pan in the appropriate position. Likewise, suction header coupling 70 is secured in suction line opening 36 of the retainer and in suction line opening 62 of the cover plate to secure the retainer relative to the cover plate. Liquid header coupling 80 likewise extends through the liquid line slot 38 of the retainer and liquid line opening 64 of the cover plate to additionally provide support for the unit. A screw may be inserted through retainer fastener hole 68 in the cover plate into the retainer to provide additional support.

When the cover plate is assembled to the casing the cover plate secures drain projection 44 and retainer 34. In the assembled position, the couplings extend through suction line opening 62 and liquid line opening 64 such that the refrigerant connections to the remainder of the refrigeration circuit may readily be made thereto.

As shown in FIGS. 2 and 3, the identical heat exchange unit may be mounted in a horizontal or vertical position using the cover plate as shown. To promote interchangeability of parts between various heat exchange units it is desirable to have heat exchangers capable of being mounted at different angles within the units and having different lengths, sizes and other parameters. The condensate pan, as shown, may be utilized with various size heat exchangers and mounted at various angles. By providing a retainer secured to the tube sheet flange various heat exchangers may be mounted at different angles.

The retainer defines liquid line slot 38 and suction opening 36. When suction header 70 and liquid header 80 are mounted to the retainer, the heat exchanger is capable of movement relative to the casing such that the heat exchanger may be secured in different locations. The suction header serves as a pivot and the liquid header may be secured in any position along liquid line slot 38. Hence, to provide different heat exchanger arrangements, a different mounting may be provided by merely changing cover plate 60. The cover plate is changed to reposition liquid line opening 64, suction line opening 62 and the angle at which drain projection opening 66 secures the condensate pan. By changing these angles or locations of the cover plate it is possible to utilize the same heat exchanger retainer and condensate pan for various heat exchange units. The same condensate pan and retainer may also be used with heat exchangers of varying dimensions.

The condensate pan may be secured to the tube sheets of the heat exchanger by providing various projections and embossments in the condensate pan. For details of similar attachment methods see United States patent 3,882,690.

When the unit is mounted in the vertical position the condensate collected on the fins tends to flow downwardly along the fins. The condensate drips off the bottom of the fins into condensate pan 30. When the unit is mounted in the horizontal position as shown in FIG. 1 the condensate also tends to flow along the fin surface in a downwardly direction from the end of the heat exchanger adjacent bracket 22 towards the condensate pan. Since the angle of the heat exchanger from vertical when the unit is in the horizontal position is less than when the unit is in the vertical position some condensate may fall from the fins rather than flowing downwardly along the fins. Drip pan 32 is positioned to collect this condensate that falls and to conduct the condensate to condensate pan 30.

The invention herein has been described in detail with particular reference to the preferred embodiment thereof, but it will be understood that variations and modifications can be effected within the spirit and scope of the invention.

What is claimed is:

1. A combination coupling retainer and support assembly for use with a plate fin heat exchanger having a tube sheet, a liquid header and a suction header which comprises:

a retainer comprising a face portion which defines an arcuate liquid line slot and a suction line opening and an extension portion for securing the face portion to the tube sheet of the heat exchanger;

liquid line coupling means secured to the liquid header and located to extend through the liquid line slot of the face portion to slide along the slot as the heat exchanger is rotated; and suction line coupling means secured to the suction header and positioned to be secured within the suction line opening to serve as an axis of rotation for the heat exchanger relative to the coupling retainer.

2. The apparatus as set forth in claim 1 wherein the liquid line slot comprises a head portion and a curvilinear tail portion formed on an arc having the suction line coupling as its center of rotation such that the combination coupling and retainer may be utilized with the heat exchanger positioned at varying angles.

3. The apparatus as set forth in claim 1 and further comprising:

a cover plate defining a liquid line opening and a suction line opening through which the liquid line coupling and the suction line coupling extend;

means to secure the cover plate to the retainer; and means to secure the cover plate to a support means.

4. The apparatus as set forth in claim 3 and further comprising a condensate pan attached to the heat exchanger, wherein the cover plate further defines a drain projection opening and wherein the condensate pan includes a drain projection sized to extend through the drain projection opening.

5. A heat exchange unit for transferring heat energy between refrigerant and air which comprises:

a casing defining an air flow path;

a heat exchanger having refrigerant flowing therethrough and being located in the air flow path for effecting heat transfer between the refrigerant and air, said heat exchanger including a liquid header and a suction header;

a coupling retainer mounted to the heat exchanger and defining an arcuate liquid line slot and a suction line opening, the suction line opening being the center point for the arc defined by the liquid line slot;

a liquid line coupling connected to an end of the liquid header and extending through and slidably within the liquid line slot in the coupling retainer;

a suction header coupling connected to one end of the suction header and extending through the suction line opening of the retainer, said suction header serving as a pivot point about which the coupling retainer and attached heat exchanger may be rotated with the liquid line coupling sliding within the liquid line slot; and a cover plate defining a liquid line opening through which the liquid header extends and a suction line ooening through which the suction header extends, said cover plate securing the liquid line coupling from sliding within the liquid line slot.

6. The appartus as set forth in claim 1 wherein the cover plate is secured to the casing and wherein the cover plate defines a retainer fastener hole for allowing the cover plate to be secured to the retainer with a fastening means in addition to the liquid line opening and suction line opening securing respectively the liquid header coupling and the suction header coupling.

7. The apparatus as set forth in claim 1 wherein the liquid line slot includes a curvilinear tail portion and an enlarged head portion, the liquid line slot being positioned to allow the liquid header and attached coupling to be rotated about the suction header as a pivot point.

8. The apparatus as set forth in claim 7 wherein the heat exchanger includes a tube sheet at each end thereof, at least one tube sheet including a tube sheet flange and wherein the coupling retainer comprises a face portion defining the liquid line slot and the suction line opening, and an extension portion connecting the face portion to the tube sheet flange of the heat exchanger.

9. The apparatus as set forth in claim 7 and further comprising a condensate pan including a drain projection attached to the heat exchanger and wherein the cover plate defines an opening for receiving the drain projection.

* * * * *